US005326949A

United States Patent [19]

Mannuss et al.

[11] Patent Number: 5,326,949

[45] Date of Patent: Jul. 5, 1994

[54] ADJUSTABLE DEVICE, PARTICULARLY AN ELECTRIC SWITCHING, CONTROLLING OR REGULATING DEVICE

[75] Inventors: Siegfried Mannuss, Sternenfels, Fed. Rep. of Germany; Emmett L. Nichols, Whitesburg, Ga.

[73] Assignee: E.G.O. Elektro-Gerate Blanc u. Fischer, Fed. Rep. of Germany

[21] Appl. No.: 48,160

[22] Filed: Apr. 15, 1993

Related U.S. Application Data

[63] Continuation of Ser. No. 687,177, Apr. 18, 1991, abandoned.

[51] Int. Cl.[5] ..... H01H 19/10

[52] U.S. Cl. ..... 200/336; 200/566; 200/338; 200/341; 200/520; 200/43.04; 200/17

[58] Field of Search ..... 200/17, 566, 564, 565, 200/567, 568, 336, 338, 341, 345, 520, 43.04, 43.08

[56] References Cited

U.S. PATENT DOCUMENTS

| | | | |
|---|---|---|---|
| Re. 31,597 | 5/1984 | Fischer et al. . | |
| 2,774,852 | 12/1956 | Boardman | 200/338 |
| 3,149,215 | 9/1964 | Nise | 200/566 |
| 3,230,793 | 1/1966 | Allison . | |
| 3,511,956 | 5/1970 | Fields | 200/338 |
| 3,657,496 | 4/1972 | Davidson | 200/336 |
| 3,974,097 | 8/1976 | Rosenbeigeton | 200/566 |

FOREIGN PATENT DOCUMENTS

| | | |
|---|---|---|
| 1946887 | 4/1971 | Fed. Rep. of Germany . |
| 2604783 | 8/1977 | Fed. Rep. of Germany . |
| 2625716 | 12/1977 | Fed. Rep. of Germany . |
| 8525338 | 9/1985 | Fed. Rep. of Germany . |
| 3721955 | 1/1989 | Fed. Rep. of Germany . |
| 3803356 | 8/1989 | Fed. Rep. of Germany . |
| 1077729 | 11/1954 | France . |
| 1151033 | 2/1967 | United Kingdom . |

*Primary Examiner*—Ernest G. Cusick
*Attorney, Agent, or Firm*—Quarles & Brady

[57] ABSTRACT

An adjusting shaft for an electric regulating or control device, which operates equipment functions by means of a control cam, is profiled to engage the control cam and can be installed subsequent to the complete assembly of the control device and fixed relative to the control device by a spring detent and associated stop. The stop can also serve to prevent unintentional rotation of the control cam until displacement of the stop against the opposition of a biasing spring. The subsequently installed shaft can allow use of universal control devices with random shaft lengths and types.

9 Claims, 1 Drawing Sheet

ADJUSTABLE DEVICE, PARTICULARLY AN ELECTRIC SWITCHING, CONTROLLING OR REGULATING DEVICE

CROSS REFERENCE TO RELATED APPLICATION

This is a continuation of U.S. patent application Ser. No. 07/687,177, filed Apr. 18, 1991 now abandoned.

BACKGROUND OF THE INVENTION

Electric switches, regulators or control devices, such as those according to DE-C-26 04 783 (corresponding to GB 1 577 852) or DE-C-26 25 716 (corresponding to U.S. Pat. No. Re 31 597) have a driven element in the form of a cam disk on setting cam, which either directly or indirectly acts on contacts or switches an adjusting shaft, which drives the driven element; and locking elements driven by the adjusting shaft. The adjusting shafts are either fixed to the driven element or are inserted therein and consequently do not rotate relative to the driven element. The axial fixing of the shaft takes place by means of engagement in casing parts. This fixing can be brought about during the installation of the device by fitting an outer casing member.

As regulators or switches are often installed in devices that have widely differing designs positions of the operating or control elements, etc., it is necessary to provide different adjusting shaft lengths and shapes. It is also possible to connect additional or acessory switches to the regulators or switches other devices drive the switches by the same adjusting shaft. In this case, there must either be an indirect coupling, which operates less precisely due to its necessary clearance, or a separate switch or regulator type with a correspondingly lengthened spindle.

SUMMARY OF THE INVENTION

An object of the invention is to provide a control device of a group, including switches and regulators that allows greater installation flexibility without increasing the number of types received. According to the invention the adjusting shaft can be inserted or engaged from the outside into the device, which is, in other respects, readily installed or mounted.

The device can consequently be installed without the adjusting shaft and can be delivered in this state to the manufacturer of the finished apparatus, such as a cooker. The manufacturer can then fit a corresponding adjusting shaft, which can easily be inserted, in accordance with his individual installation conditions. It can vary as regards length, connection dimensions and connection system such as for a knob and can e.g. have corresponding extensions in order to operate additional switches, which can be flanged on the equipment.

The adjusting shaft can have a profiling by means of which it is connectable in non-rotary manner to the driven element. The axial fixing can also be brought about by an independent, barb-like connection. Preference is given to a construction where this high-speed connection is secured as a sheet metal plate in a circumferential depression of the adjusting shaft and has a spring detent, which locks behind a shoulder on the driven element, while a stop projection ensures the necessary securing effect in the pressing-in direction. This spring clip can be located in a depression of the adjusting shaft and consequently can also be laterally guided thereon.

Frequently, such switching devices must be secured against unintentional or unauthorized operation, such as by children, in that, apart from a rotation on the knob, it is also necessary to have an axial movement, such as a pressing in, in order to move it from the off position. In such a preferred construction, both the driven adjusting element, such as the trip cam, and a locking disk can be connected in rotation-fixed manner to the adjusting shaft, but only one of these elements, namely the locking disk, is fixed to the shaft in the axial direction. Thus, the spring clip engages on the locking disk, which is resiliently loaded towards the user, so that by pressing in he forces the locking disk axially out of its locked position and can then carry out the corresponding rotation. If preferably the spring acts between the locking disk and the adjusting driven control element, said elements are reciprocally secured in position before the shaft is engaged. The locking element and/or adjusting element can also be held radially in position by equipment casing surfaces before the shaft is inserted.

BRIEF DESCRIPTION OF THE DRAWINGS

These and other features of preferred developments of the invention can be gathered from the claims, description and drawings and individual features, either individually or in the form of subcombinations, can be realized in an embodiment of the invention and in other fields and can represent advantageous, independently protectable constructions for which protection is hereby claimed. An embodiment of the invention is described in greater detail hereinafter relative to the drawings, wherein:

DETAILED DESCRIPTION OF THE PREFERRED EMBODIMENTS

Figure 1:
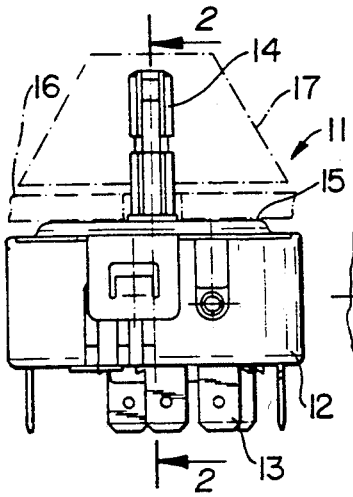
FIG. 1 shows a side view of an electric power control device.

The device shown in FIG. 1 is a timing energy control device for electrical heating equipment, particularly a cooker, which has a bimetal, heated by a control heating means, together with the equipment-switched main heating means, which controls the working contact for timing the energy supply to a not shown electric heating means. The device has a casing 12, and on its back surface, electric plug-in connection lugs 13. The released power, i.e. the relative on-period, is adjustable by means of an adjusting shaft 14, which, via an adjusting element 18 (FIG. 2) also operates signal contacts, a bipolar disconnection, which brings about a complete electrical separation in the disconnected state and can also operate additional contacts of a random type. Its construction and function can be in accordance with DE-C-26 25 715 (=U.S. Pat. No. Re. 31 597), to which reference should be made in this connection.

On the operating or control side 15 of the device, the latter is connected to a dot-dash represented part of a kitchen means or cooker, such as a shield plate 16. A knob 17 is engaged in non-rotary manner on the adjusting shaft.

Figure 2:
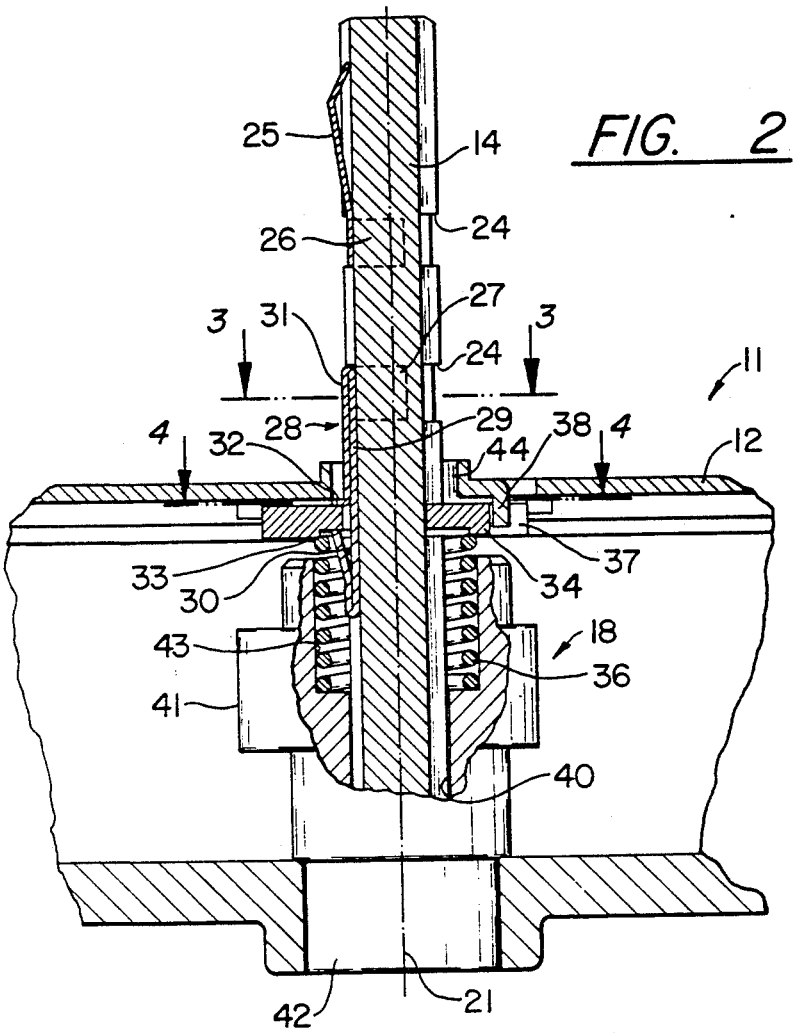
FIG. 2 shows a detail section along the section line 2—2 in FIG. 1.
Figure 3:
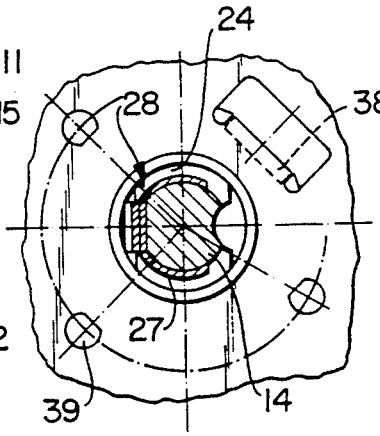
FIG. 3 shows a detail section along the section line 3—3 in FIG. 2.
Figure 4:
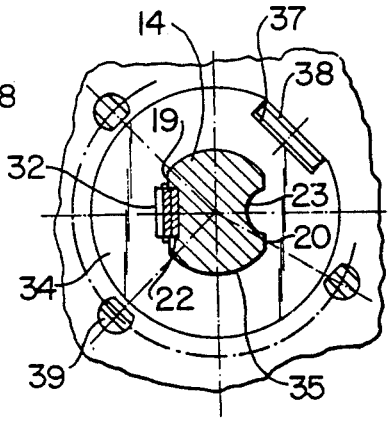
FIG. 4 shows a detail section along the section line 4—4 in FIG. 2.

FIG. 2 shows the adjusting shaft 14, its arrangement in the device 11 and its connection to the elements driven by it. The adjusting shaft is a metal profile having a generally circular cross-section (FIGS. 3 and 4), which has flattened portions 19,20 at two facing points. In the flattened portion 19 is provided an approximately rectangular recess running in the direction of the axis 21, i.e. longitudinally, while on the opposite side of the shaft 14, a differently shaped, here arcuately defined, longitudinal slot 23 is provided. Outside the device 11 the adjusting shaft has two all-round, relatively flat depressions or circular slots 24. The upper circular slot 24 received lateral clamp legs 26 of a clamp 25, which is used for retaining a knob 17, engaged thereon and which has a recess constructed corresponding to the profile of the adjusting shaft.

The lower circular slot 24 receives clamp legs 27 (FIG. 3) of a spring clip 28, which projects somewhat past the center and consequently are located in protected manner in the circular slot and fix the spring clip on the adjusting shaft. The portion 29 thereof running along the axis towards the device 11 is so bent round at its end that it forms a barb-like, resilient locking portion 30. As the portion 29 runs in the depression 22 and is consequently also laterally guided, the locking portion 30 projects beyond the circumference of the adjusting shaft 14, at least in the vicinity of the flattened portion 19 thereof.

The spring clip 28 is produced from a cruciform sheet metal blank, while the portion 31 extending the portion 29 is bent round by 180° and extends towards the device 11. A stop portion 32 is bent away radially outwards at its end. It is located at an axial distance from the free end 33 of the locking portion 30. Between the stop portion 32 and the locking portion 30 is fixed a locking element 34, which is in the form of a circular disk with a central opening 35 corresponding to the adjusting shaft profile. Under the tension of a helical spring 36, the locking element 34 is pressed onto the operating-side inner wall of the casing 12. By means of a circumferential cutout 37, the locking element 34 is locked in a sheet metal stop tongue 38 bent out of the casing and which together with the cutout 37 forms an unlockable locking means. Projections 39 arranged around the circumference of the locking element 34 guide the latter between them, so that it still remains in the orientation shown if the adjusting shaft 14 is not inserted.

The adjusting shaft projects into an opening 40 in the adjusting element 18 profiled in accordance therewith and optionally completely through it. In the represented embodiment, the adjusting element 18 contains a setting cam or cam disk 41 and a journal pin 42, which is guided in a corresponding bore of the casing 12, but allows a certain clearance. The adjusting element 18 has a recess 43 widening the opening 40 facing the operating side and in which is located the helical spring 36.

The manufacture and function of the invention take place in accordance with the following procedure. The device 11, with all its parts excepting the adjusting shaft 14, is completely installed, and an outer casing cover is also fitted. The locking element 34 and adjusting element 18 are guided through the journal pin 42 and the projections 39 in a radial direction to the axis 21 and are also axially fixed by the helical spring 36. The regulator can be delivered in this form. However, it can also be previously set with a shaft corresponding to the adjusting shaft 14. Prior to its installation in an overall apparatus, e.g. a cooking hob or some other electrical heating device, a correspondingly prepared adjusting shaft 14 is engaged from the outside through the opening 44 in the casing 12. The adjusting shaft can be of one of numerous types varying as regards length, connection type and possibly also material, or can be especially manufactured for this particular case. It is advantageous for the adjusting shaft to always have a constant profile and merely to be correspondingly deflected and provided with the circular slots 24. The same type spring clip 28 and the clamp 25 can be used for all the adjusting shaft types and are merely snapped or clamped on. This shaft can then be inserted before, or optionally after, the installation of the apparatus, so that it projects through the opening 44 and the openings 35 and 40 in the elements 34 and 18. The front portion of the spring clip 28 with the locking portion 30 passes through a correspondingly shaped opening 35 in the locking element 34, the locking portion 30 being compressed and engaging on the portion 29. Past the locking element, 34 it again snaps outwards and is locked in barb-like manner on the locking element 34. The dimensions are such that this takes place when the stop portion 32 has also engaged on the operating-side surface of the locking element 34. Thus, the latter is not only connected in the rotation direction, but also in an axially fixed manner to the shaft, locking being carried out by the automatic high-speed connection 30,32 during insertion. The regulator is now complete and it is merely necessary to engage the knob 17, after the regulator has been incorporated into a corresponding plate 16 of the overall apparatus.

The represented push-to-turn constructional embodiment operates in such a way that by locking means 37,38 the locking element 34 is fixed in the rotation direction until, by pressure on the adjusting shaft 14, the locking disk is moved on the adjusting element 18 in opposition to the tension of the helical spring 36, so that the stop tongue 38 comes free from the cutout 37 and a rotation can be carried out. The adjusting shaft moves axially in the adjusting element 18. However, both elements 18,34 are moved together during rotation. On rotating into the control device off position, the stop tongue and cutout 37 again engage, so that once again the apparatus is secured against unauthorized rotation.

Numerous variants of the represented and described embodiment are possible within the scope of the invention. In a construction in which no rotation securing effect is required, the axial, locking fixing of the adjusting shaft can either take place on a casing part or on the adjusting element 18, e.g. by means of an inner collar in the vicinity of the recess 43. However, other high-speed connecting means are possible, but the described spring clip can be manufactured particularly easily and can in particular subsequently be fitted to the adjusting shaft. The invention can be used with numerous types of adjustable equipments, particularly for electric switches, cam-operated multiple switches, temperature regulators or, in a particularly preferred manner, in the described power control devices.

In all constructions, the major advantage occurs that the multiplicity of types of the devices can be significantly reduced, because it is not only possible to provide similar equipments with different adjusting shafts corresponding to the installation requirements, but also the same adjusting shaft types are usable for different devices or device combinations.

We claim:

1. An electric control device comprising:

a closeable housing having a housing opening;

a control shaft insertable into said housing opening;

at least one adjustable control element enclosed in said housing to be driven by manipulation of said control shaft, said at least one adjustable control element having an engagement opening for receiving the control shaft;

means for radially positioning said control element within said housing so that the engagement opening is aligned with the housing opening to receive the control shaft there through;

quick connection means secured to said control shaft for axially securing said control shaft relative to said at least one adjustable control element, said quick connection means permitting insertion at said control shaft into said at least one adjustable control element through said housing and inhabiting retraction therefrom, wherein said positioning means includes radial guidance means connected to the casing for positioning said at least one adjustable control element.

2. The device according to claim 1, wherein the control shaft and the adjustable control element engage along a circumference of the control shaft.

3. The device according to claim 2, wherein the control shaft adjusts the adjustable control element by substantially mating engagement of the profile of the control shaft with the engagement opening of the adjustable control element.

4. The device according to claim 1, wherein the quick connection means is an automatic, positively acting snap connection.

5. The device according to claim 1, further comprising an annular locking element having an opening and secured to said housing so that the opening is aligned with the housing opening to receive said control shaft therethrough.

6. The device according to claim 5, wherein the locking element is axially moveable relative to at least one adjustable control element and has means for locking rotation of the shaft relative to the casing, which locking means can be unlocked by said relative axial movement.

7. An electrical control device comprising:

a control shaft having a circumferential recess;

at least one adjustable control element for controlling electric equipment functions, adjusted by manipulation of said control shaft;

a housing for said at least one adjustable control element providing an aperture for passage of said control shaft therethrough, wherein the control shaft is insertable through said aperture and has a spring clip secured to the control shaft, said spring clip having a clamping portion secured to said circumferential recess of the shaft, a locking portion bent away in barb-like manner from the shaft and a radially projecting stop portion, said locking portion axially securing said shaft relative to said adjustable control element in said stop portion limiting the depth of insertion of the control shaft into said adjustable control element.

8. The device according to claim 7, wherein said portion of the spring clip is strip-like.

9. An electric control device comprising:

a closeable housing having a housing opening;

a control shaft insertable into said housing opening;

at least one adjustable control element enclosed in said housing to be driven by manipulation of said control shaft, said at least one adjustable control element having an engagement opening for receiving the control shaft;

means for radially positioning said control element within said housing so that the engagement opening is aligned with the housing opening to receive the control shaft therethrough; and quick connection means secured to said control shaft for axially securing said control shaft relative to said at least one adjustable control element, said quick connection means permitting insertion of said control shaft into said at least one adjustable control element through said housing and inhibiting retraction therefrom, wherein the control shaft has a recess and the quick connection means is a spring clip secured in said recess of the control shaft.

* * * * *